US006546884B1

(12) United States Patent
Rodriguez

(10) Patent No.: US 6,546,884 B1
(45) Date of Patent: Apr. 15, 2003

(54) JET PROPELLED WATERCRAFT STABILIZING SYSTEM

(76) Inventor: Javier Rodriguez, P.O. Box 87, Kula, HI (US) 96790

( * ) Notice: Subject to any disclaimer, the term of this patent is extended or adjusted under 35 U.S.C. 154(b) by 0 days.

(21) Appl. No.: 10/080,841

(22) Filed: Feb. 22, 2002

(51) Int. Cl.[7] ..... B63B 35/73

(52) U.S. Cl. ..... 114/55.5; 114/129; 441/79

(58) Field of Search ..... 441/79; 114/55.5, 114/55.56, 55.57, 127, 129, 142

(56) References Cited

U.S. PATENT DOCUMENTS 3,088,428 A * 5/1963 Majnoni ..... 114/129
4,493,665 A * 1/1985 Liddle ..... 114/127
4,556,005 A * 12/1985 Jackson ..... 114/146
4,964,821 A * 10/1990 Tafoya ..... 114/345
5,030,151 A * 7/1991 Beacham ..... 114/127
5,235,926 A 8/1993 Jones
RE35,351 E 10/1996 Morgan
5,611,295 A 3/1997 Stables
5,908,006 A * 6/1999 Ibata ..... 114/123
6,041,727 A 3/2000 Yamada

FOREIGN PATENT DOCUMENTS

JP 2001-233288 * 8/2001

* cited by examiner

*Primary Examiner*—Sherman Basinger

(57) ABSTRACT

A stabilizing system for jet-propelled watercraft comprising a pair of fins and their corresponding trim blocks, which serve to point the fins in the correct toed-in, cambered-out attitude, and mount on the side of the watercraft, toward the rear.

5 Claims, 2 Drawing Sheets

JET PROPELLED WATERCRAFT STABILIZING SYSTEM

FEDERALLY SPONSORED RESEARCH

Not Applicable

SEQUENCE LISTING OR PROGRAM Not Applicable

1. Field of Invention

This invention relates to stabilizing systems for jet-propelled watercraft.

2. Description of Prior Art

Jet-propelled watercraft, lacking the stabilizing force of a propeller in the water, are imprecise in handling, especially when turning. Driving fast can be sketchy and erratic, and hard turns result in sliding and spin-outs, which not only stop forward progress, but can throw the driver and passengers off the boat and cause bodily injury.

One previous attempt to improve the handling of jet-propelled watercraft was to modify the drive plate of the watercraft. One variation of this is U.S. Pat. No. RE35,351, inventor Robert D. Morgan. The drive plate is the center part of the bottom at the stem (back) of the watercraft, and the modifying effort consists of creating longitudinal grooves in the drive plate, to encourage the jet-propelled watercraft to continue in its course. The effects, if any, are minimal.

Another gadget designed to provide control to jet-propelled watercraft, is the so-called "stabilizer". These stabilizers consist of two blocks of plastic, about five centimeters wide, eight centimeters tall, and up to 600 centimeters long, which mount longitudinally to the sides of the boat towards the stem. These little units project their two-inch width horizontally, creating two mini platforms that help keep the boat from tipping from side to side at speed.

Rather than helping the handling, these "stabilizers" serve as "training wheels", keeping the watercraft a little more stable, at the loss of fine control and sensitivity. As far as affecting the fuming characteristics, their effect is negligible.

The other method currently in use to improve jet-propelled watercraft's handling is the use of sponsors. Sponsors are trapezoidal plates of plastic, five to eight centimeters tall by up to about 600 centimeters long, which mount longitudinally on each side of the boat, toward the stem. Rather than extending their width horizontally as the "stabilizers" do, sponsors project their width vertically. Their long edges in the water help give the watercraft some stability in the straights, and a little extra bite in the turns. However, the sponsors' inexact placement, incorrect trim angles, and shallow depth keep them from being a real handling solution, and their straight, longitudinal edges provide a clumsy, inexact turning fulcrum.

A couple of inventions refine the sponson concept, U.S. Pat. No. 5,611,215, by Lloyd J. Stables, and U.S. Pat. No. 6,041,727, by Hisato Yamada, Mitsuhisa Hirano, and Yasukazu Kojima, but neither one addresses the sponsons' built-in limitations of insufficient height, incorrect angle of attack, and inefficient and crude shape.

OBJECTS AND ADVANTAGES

Several objects and advantages of the jet-propelled watercraft stabilizing system described in my above patent are:

a. To provide a jet-propelled watercraft stabilizing system which enables the watercraft to drive accurately in a straight line, and respond predictably to the driver's steering inputs.

b. To provide a jet-propelled watercraft stabilizing system that allows the driver to make severe turns with control and precision.

Further objects and advantages are to provide a jet-propelled watercraft stabilizing system, which, through increasing the driver's level of control, makes jet-propelled watercraft safer and more fun to use.

SUMMARY

The invention comprises a set of fins, and their trim blocks, which point the fins to the correct direction and angle.

DRAWINGS

Drawing Figures

REFERENCE NUMERALS IN DRAWINGS

A prior art

10 fin

11 fin mounting holes

12 trim block

13 fin mounting points

Figure 1:
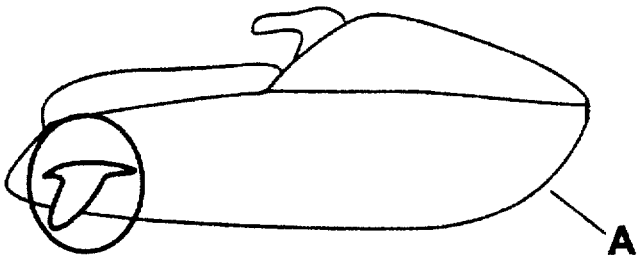
FIG. 1 shows the position of one side of the stabilizing system on a jet-propelled watercraft

14 trim block to boat mounting holes

15 trim block with adjustable angles

16 shim for adjusting trim block angles

17 side of watercraft

18 trim block to watercraft side mounting hardware

19 fin to trim block mounting hardware

DETAILED DESCRIPTION

Description—FIGS. 1, 2, 5, 7, 8—Preferred Embodiment

Figure 2:
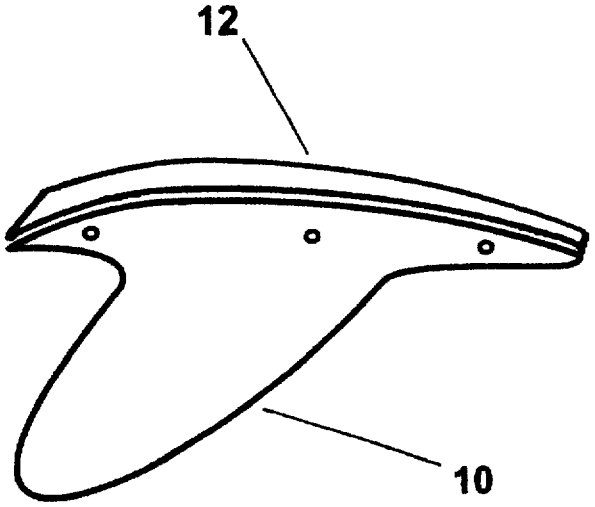
FIG. 2 shows the fin and trim block assembly.
Figure 3:
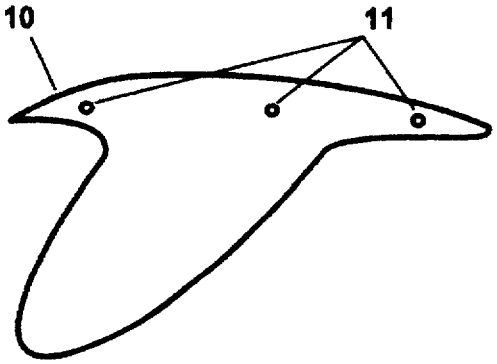
FIG. 3 shows a fin.
Figure 7:
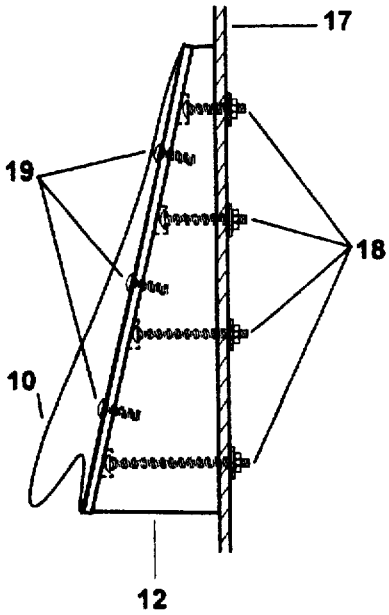
FIG. 7 shows a view of the fin and trim block assembly from the top, demonstrating how the shape of the trim block imparts toe-in to the fin, how the fin attaches to the trim block, and how the trim block attaches to the side of the watercraft.
Figure 8:
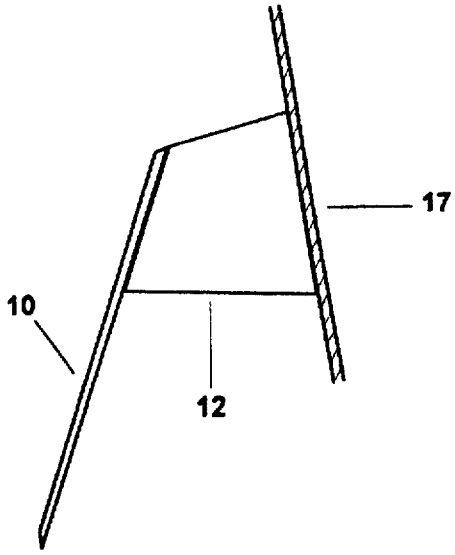
FIG. 8 shows the trim block and fin assembly from the rear, demonstrating how the shape of the trim block imparts camber-out to the tip of the fin.

A preferred embodiment of the jet-propelled watercraft stabilizing system is attached to the watercraft as illustrated in FIGS. 1 and 7. The system consists of two fins and their corresponding trim blocks, as shown in FIG. 2.

The trim blocks are made of some durable material, such as plastic or wood, attached to the sides of the watercraft at the mounting points of the existing "stabilizers", or if no "stabilizers" are present, toward the rear of the boat, at about the waterline. The shape of the trim blocks, with their narrower front than back and wider bottom than top, as in FIGS. 7 and 8, sets up the fins with the correct toe-in, whereby the fronts of the fins are closer together than the backs; and camber-out, whereby the tips of the fins are further apart than their bases. This attitude of the fins provides for centered straight line driving, and positive, sensitive turning.

Figure 5:
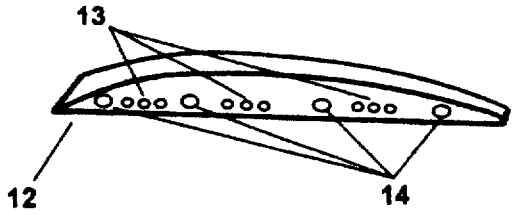
FIG. 5 shows a detailed view of an adjustable trim block.

In this preferred embodiment, the trim blocks have multiple mounting points for the fins, as shown in FIG. 5, so that the fins may be mounted forward or back. The fins, which are made of fiberglass, phenolic, or some other durable, strong, flexible material, are then attached to which ever set of mounting points the operator selects, with the principle that the further back the fins are mounted, the longer the turning circle of the craft. This adjustable trim block system also allows easy fin changes. In this preferred embodiment, the fins are swept back, roughly triangular, with a smooth rounded outline, and a foiled outside and flat inside surface, but they can take various forms. The size of the fins varies with the amount of control desired and the size of the watercraft.

Additional Embodiments

An additional embodiment has the body of the watercraft shaped to provide the correct trim angles, obviating the need for a trim block.

Figure 4:
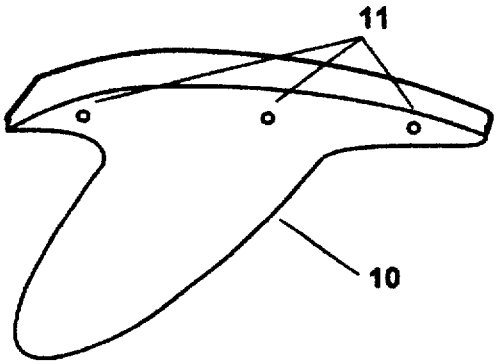
FIG. 4 shows a fin and trim block as one unit.

Another embodiment has the trim block and fin in one unit, as shown in FIG. 4.

Figure 6:
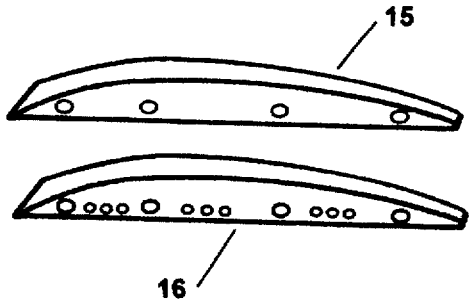
FIG. 6 shows an adjustable trim block and a shim to adjust the trim angles.

Another embodiment has an adjustable trim block with shims that vary the fin angles, as in FIG. 6.

A further embodiment has the watercraft, trim block and fin in one unit.

Another embodiment has non-adjustable fins.

Another embodiment mounts the watercraft stabilizing system to the back of the watercraft.

Another embodiment mounts the watercraft stabilizing system to the bottom of the watercraft.

ADVANTAGES

From the description above, a number of advantages of my jet-propelled watercraft stabilizing system become evident:

The fins set to the correct toed-in and cambered-out angles provide a centering force when driving at planing speeds that keeps the watercraft steady and predictable, and prevents twitchiness and erratic behavior. In addition, my stabilizing system provides the watercraft with totally predictable, positive steering even in the hardest turning conditions, with none of the sliding and spin out characteristics of unaided jet powered watercraft. My stabilizing system also provides a very smooth side-to-side transition in the turns, due to the cambered-out fin tips, for enhanced operator satisfaction and safety. This stabilizing system also gives the watercraft much more control in the surf and white water, important for lifeguard and other safety patrol use in the ocean. Watercraft set up with my stabilizing system are much safer to drive, especially when driven at high speeds and in demanding conditions.

OPERATION

The manner of using the jet-propelled watercraft stabilizing system is to drive as usual in the straights, and to lean the watercraft into turns. This leaning is instinctive, and causes the fin on the inside of the turn to grab and keep the back of the craft from sliding out. If the driver wants to experience the unaided watercraft's sliding characteristics, all he or she has to do is not lean into the turn, which reduces the effect of the fin on the turn, and lets the watercraft slide out. The preferred embodiment of the Invention features trim blocks with a series of fin mounting inserts, as in FIG. 6, so that the fins can be adjusted forward and back, or replaced. When using this embodiment, the driver can adjust the fins forward to create a tighter turning circle, or move the fins back to lengthen the turning circle. The operator can also change the fins to reflect changing conditions, using larger fins for more effect and smaller ones for less, etc.

CONCLUSIONS, RAMIFICATIONS, AND SCOPE

Accordingly, the reader will see that the jet-propelled watercraft stabilizing system of this invention provides jet-propelled water crag with the handling control that every driver wants: predictable straight line performance, without twitchiness and wandering; precise turning ability, without sliding and spinning out; and unparalleled control in the surf or rough water. These features also make the watercraft a much safer vehicle, especially if the watercraft is designed to go as fast as 60 mph, as many of them are.

Although the description above contains many specificities, these should not be construed as limiting the scope of the invention but as merely providing illustrations of some of the presently preferred embodiments of this invention. For example, there could be various sets of smaller fins working in array, the fins could be different shapes, the stabilizing system could be mounted to the bottom of tire watercraft, etc. Thus the scope of the invention should be determined by the appended claims and their legal equivalents, nether than by the examples given.

I claim:

1. A jet propelled watercraft having a front, a rear, a first side, a second side, a waterline and a stabilizing system, the stabilizing system comprising:

a first fin and a second fin, said first fin and said second fin each having a front, a rear, a tip and a base;

a first trim block and a second trim block, said first trim block and second trim block each having a front, a rear, a top, and a bottom, said front being more narrow than said rear and said bottom being wider than said top, the shape of each trim block being defined by the more narrow front and the wider bottom;

said first trim block being mounted on said first side of said watercraft toward the rear of said watercraft at about the waterline of said watercraft, said second trim block being mounted on said second side of said watercraft toward the rear of said watercraft at about the waterline of said watercraft;

said first trim block mounting said first fin on said first side of said watercraft toward the rear of said watercraft at about the waterline of said watercraft, said second trim block mounting said second fin on said second side of said watercraft toward the rear of said watercraft at about the waterline of said watercraft, said first trim block and said second trim block mounting said first fin on said first side of said watercraft and said second fin on said second side of said watercraft such that the shape of said first trim block and the shape of said second trim block provide said first fin and said second fin with a correct toe-in and a correct camber-out, said correct toe-in having said front of said first fin and said front of said second fin closer to each other than said rear of said first fin and said rear of said second fin, and the correct camber-out having said tip of said first fin and said tip of said second fin further apart from each other than said base of said first fin and said base of said second fin;

and wherein said first fin and said second fin provide a centering force for said watercraft when driving said watercraft at planing speeds so as to keep said watercraft steady, predictable, precise in handling and with enhanced turning ability.

2. The jet propelled watercraft of claim 1 wherein said first fin is integral with said first trim block.

3. The jet propelled watercraft of claim 1 wherein said second fin is integral with said second trim block.

4. The jet propelled watercraft of claim 1 wherein said first fin, said first trim block and said watercraft are integral.

5. The jet propelled of claim 1 wherein said second fin, said second him block and said watercraft are integral.

* * * * *

UNITED STATES PATENT AND TRADEMARK OFFICE
Certificate

Patent No. 6,546,884 B1 Patented: April 15, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Javier Rodriguez, Kula HI; and Victoria A. Kuzmic, Kula, HI.

Signed and Sealed this Twenty-eighth Day of June 2005.

S. JOSEPH MORANO
*Supervisory Patent Examiner*
Art Unit 3617